US005408242A

United States Patent [19]

Nakase

[11] Patent Number: 5,408,242

[45] Date of Patent: Apr. 18, 1995

[54] GLASS ANTENNA FOR AUTOMOBILES

[75] Inventor: Kazuhiko Nakase, Tokyo, Japan

[73] Assignee: Harada Kogyo Kabushiki Kaisha, Tokyo, Japan

[21] Appl. No.: 159,033

[22] Filed: Nov. 29, 1993

Related U.S. Application Data

[63] Continuation of Ser. No. 831,479, Feb. 5, 1992, abandoned.

[51] Int. Cl.[6] ..... H01Q 1/32; H01Q 1/02

[52] U.S. Cl. ..... 343/704; 343/713

[58] Field of Search ..... 343/704, 713; H01Q 1/32

[56] References Cited

U.S. PATENT DOCUMENTS 5,083,134 1/1992 Saitou et al. ..... 343/713

*Primary Examiner*—Michael C. Wimer

*Attorney, Agent, or Firm*—Koda and Androlia

[57] ABSTRACT

An automobile antenna including a defogging heater wire and a conductor combined into a simple structure to accomplish a good FM reception. A capacitor which effects high-frequency grounding of the terminals of the defogging heater wire is installed between the terminals and a vehicle body. The heater wire which resonates in the FM frequency band but not in the AM frequency band is capacitively coupled to the conductor which resonates in the FM frequency band but not in the AM frequency band. The heater wire and the conductor are installed in such a positional relationship that a double resonance is created.

2 Claims, 4 Drawing Sheets

GLASS ANTENNA FOR AUTOMOBILES

This is a continuation of application Ser. No. 07/831,479, filed Feb. 5, 1992, now abandoned.

BACKGROUND OF THE INVENTION

1. Field of Industrial Utilization

The present invention relates to a glass antenna for automobiles which uses, as a part of the antenna, a defogging heater wire installed in the rear windshield and more particularly to an antenna which is a combination of the heater wire and a separately mounted antenna to receive FM and AM broadcasts, etc.

2. Prior Art

The antenna shown in FIG. 6 is known as an example conventional automobile glass antenna.

In the antenna shown in FIG. 6, a main antenna A which has an antenna output terminal is formed on the surface of window glass 10 as a separate element from a defogging heater wire H. Generally, main antennas are formed in an asymmetrical shape so that they are resonant in the FM frequency band at the most optimized reception and maintain the improved FM directionality. However, even if such a structure is taken, matching cannot be accomplished for the entire FM reception frequency band because the area which can be used as an antenna is small. As a result, the FM reception sensitivity is low, and the FM directionality cannot be improved sufficiently. In addition, AM reception sensitivity is also low. As a result, in order to improve the FM and AM reception sensitivities, an FM compensating amplifier 31 and an AM compensating amplifier 32 are used between the antenna output terminal and a feeder cable F.

In the above-described conventional antennas, a matching for the entire FM reception frequency band cannot be obtained, which results in FM reception sensitivity drop. This is the reason for using the FM compensating amplifier 31. When the FM compensating amplifier 31 is used, it is necessary that such an amplifier 31 is a broad-band amplifier which can cover the entire FM reception frequency band. This, however, brings about noise and cross-modulation or inter-modulation in intense electric fields.

The object of the present invention is to provide a glass antenna for automobiles which has a good FM reception with a simple structure of a combination of a heater wire and a conductor.

SUMMARY OF THE INVENTION

In the present invention, a capacitor, which grounds the heater wire in terms of high-frequency, is installed between heater wire terminals and a vehicle body. The heater wire which resonates in the FM frequency band but not in the AM frequency band is capacitively coupled with a conductor which is installed on the surface of window glass and resonates in the FM frequency band but not in the AM frequency band, and the defogging heater wire and conductor are installed in such a positional relationship that they create a state of double resonance.

DETAILED DESCRIPTION OF THE INVENTION

Figure 1:
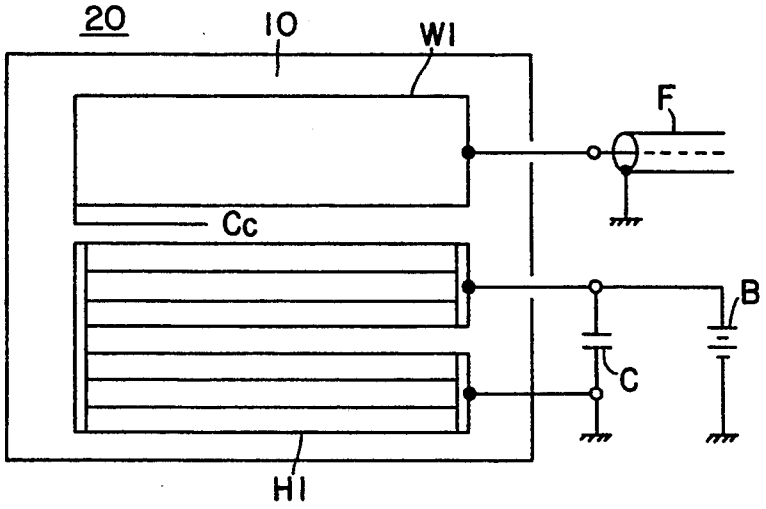
FIG. 1 illustrates one embodiment of the present invention.

FIG. 1 is a block diagram representing one embodiment of the present invention.

This embodiment is for an automobile glass antenna which receives FM and AM reception frequency bands and is composed of a heater wire Hi, a wire (conductor) W1 and a capacitor C.

The heater wire H1 is one used to remove window glass fog (called "defogging heater wire"). This defogging heater wire H1 can resonate in the FM reception frequency band but not in the AM frequency band. The wire W1 can resonate in the FM reception frequency band but not in the AM reception frequency band and is installed in a window glass 10. The wire W1 has an output terminal, and a feeder F is connected to the output terminal of this wire W1. A part of the wire W1 creates a coupling capacitance Cc between itself and the heater wire Hi.

The capacitor C effects a high-frequency grounding of the terminals of the heater wire H1. The capacitance of this capacitor C is 500 pF or greater, preferably 1000 to 5000 pF. The heater wire HI has a folded-back shape, and one end of the terminal of the wire H1 is grounded directly to the automobile body 20 and another end is grounded in terms of high-frequency via the capacitor C. Thus, the heater wire H1 forms an antenna with one end (the right end in FIG. 1) grounded and another end (the left end in FIG. 1) open.

For the FM reception frequency, the heater wire Hi and wire W1 are capacitively coupled (the coupling capacitance is shown as Cc). The heater wire H1 and wire W1 are installed in a positional relationship such that the coupling strength is more or less a critical coupling value, thus forming a state of double resonance. The coupling strength can vary depending upon the magnitude of the coupling capacitance Cc formed by the heater wire H1 and a part of the wire W1, and such a coupling strength can also vary based upon the positional relationship between the two. When the coupling strength becomes greater than the critical coupling value, the frequency band characteristics (reflection loss characteristics) can change from single-peak characteristics to double-peak characteristics. The optimal coupling between the two is obtained by changing, with a use of a network analyzer, the positional relationship and coupling capacitance Cc of the heater wire H1 and wire W1 until a desired frequency band range is obtained and until a dimensional, positional relationship and coupling capacitance which produce the minimum reflection loss are obtained.

For the AM reception frequency band, only the wire W1 acts as an antenna. Accordingly, the shape and position of the wire W1 are determined so that a stray capacitance of the wire W1 is minimal. More specifically, an antenna with a small stray capacitance can be obtained if the wire W1 is provided approximately 3 cm or higher above the automobile body 20 and the heater wire H1.

Next, the operation of the above-described embodiment will be described.

An FM reception will be described first.

Figure 2A:
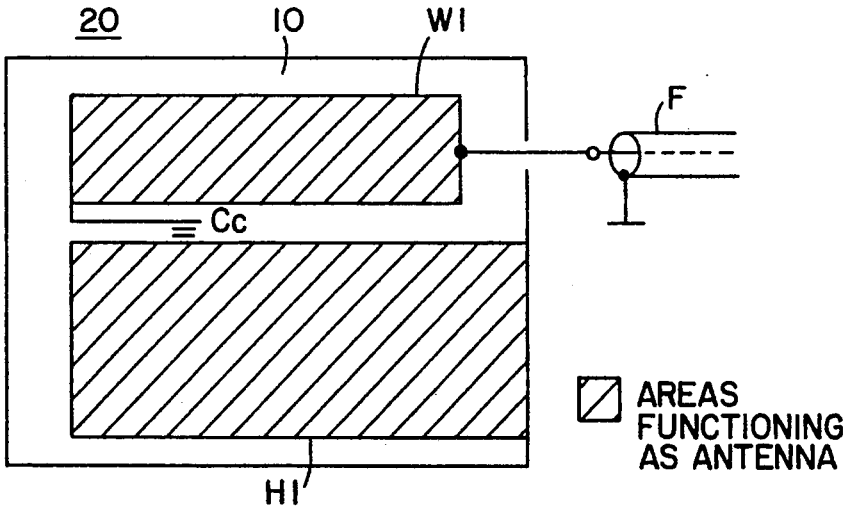
FIGS. 2 (*a*) and 2 (*b*) show the principle of operation for an FM reception frequency band and an equivalent circuit therefor in the embodiment above.
Figure 2B:
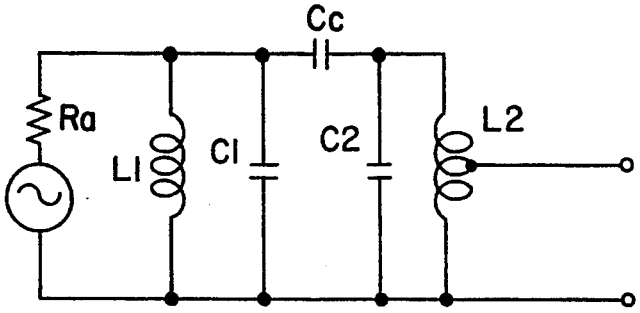

FIG. 2 shows a principle of operation and an equivalent circuit for the FM reception frequency band.

For the FM reception frequency band, as shown in FIG. 2(*a*), both the wire W1 and heater wire H1 act as an antenna. The wire W1 and heater wire H1 are both resonant in the FM reception frequency band and are capacitively coupled together so that a state of double resonance is created. The coupling strength of the two is more or less in a critical coupling; accordingly, the frequency band characteristics (reflection loss characteristics), when seen from the antenna output terminal (i.e., the terminal of the wire W1), show double-peak characteristics, thus broad-band characteristics are obtained. As a result, matching of the antenna and feeder F can be obtained for the entire FM reception frequency band, and thus a good FM reception is obtained without using the FM compensating amplifier 31 which is necessary in the conventional antennas. In addition, since the terminals of the heater wire H1 are grounded in terms of high-frequency by the capacitor C, the entry of noise from the power supply B into the heater wire H1 is prevented.

In the equivalent circuit shown in FIG. 2(*b*), the equivalent capacitance C1 and equivalent inductance L1 of the heater wire H1 and the radiation resistance Ra of the antenna exist as conceptional entities. The equivalent capacitance C2 and equivalent inductance L2 of the wire W1 also exist as conceptional entities.

Next, an AM reception in the above-described embodiment will be described.

Figure 3A:
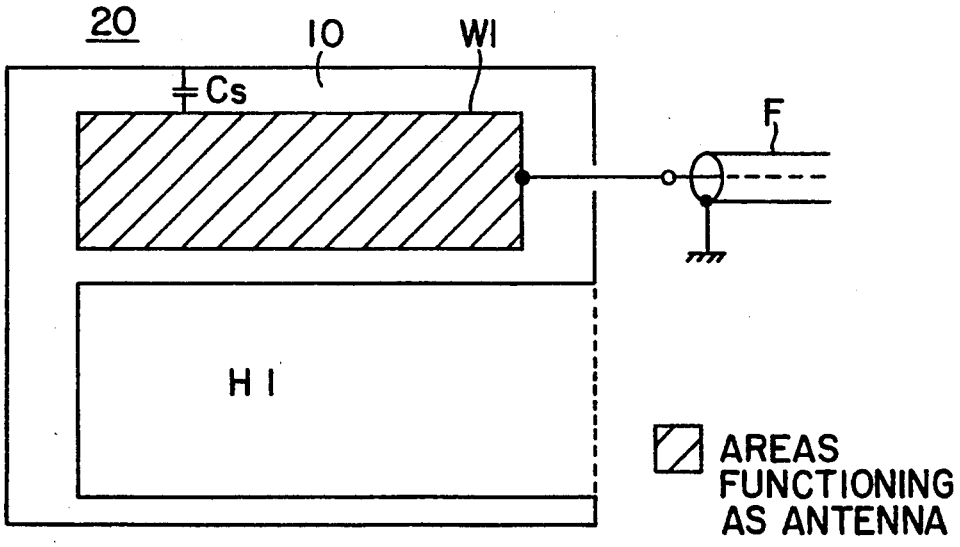
FIGS. 3(*a*) and 3(*b*) show the principle of operation for an AM reception frequency band and equivalent circuit therefor in the embodiment above.
Figure 3B:
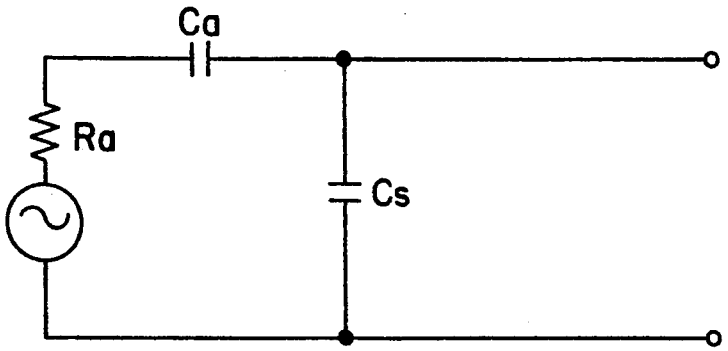

FIG. 3 shows the principle of operation and an equivalent circuit for an AM reception frequency band. For the AM reception frequency band, only the wire W1 acts as an antenna. The reason why only the wire W1 can act as an antenna is that the wire W1 and the heater wire H1 are both extremely short in length compared to the AM reception wavelength, and since one end of the heater wire H1 is grounded, the heater wire H1 is more or less equivalent to a grounding conductor; and as a result, there is absolutely no electrical coupling between the wire W1 and the heater wire H1. Because of this fact, there is no inflow of noise from the power supply B into the wire W1 during the AM reception.

In the above embodiment, since the wire W1 and the automobile body 20 (i.e., the vehicle body as a grounding plate) are sufficiently spaced, the antenna has only a small stray capacitance. Accordingly, the capacitance splitting loss, which is caused by antenna capacitance Ca (which acts effectively as an antenna) and stray capacitance Cs (which acts ineffectively), can be minimal, and therefore, an effective AM reception is obtainable.

Figure 4:
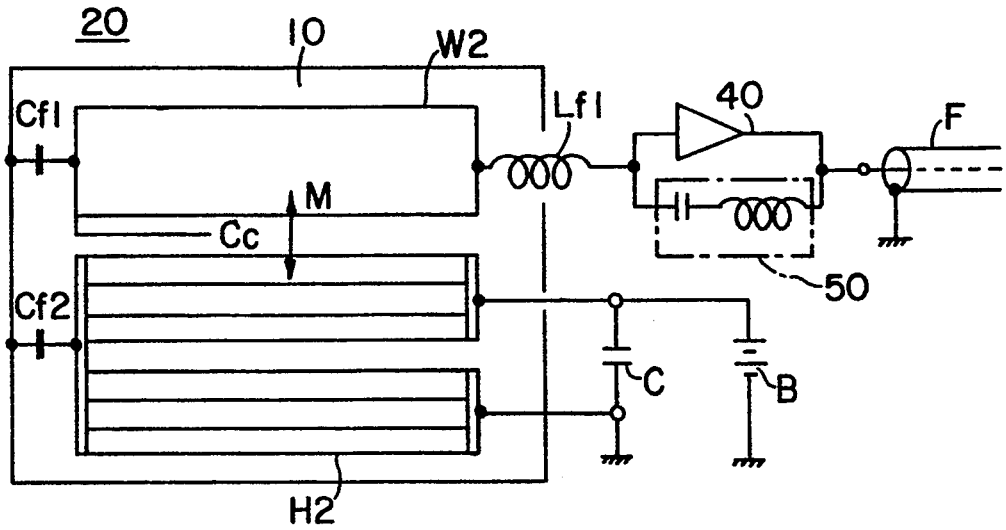
FIG. 4 illustrates another embodiment of the present invention.

FIG. 4 is a circuit diagram of another embodiment of the present invention.

Figure 5:
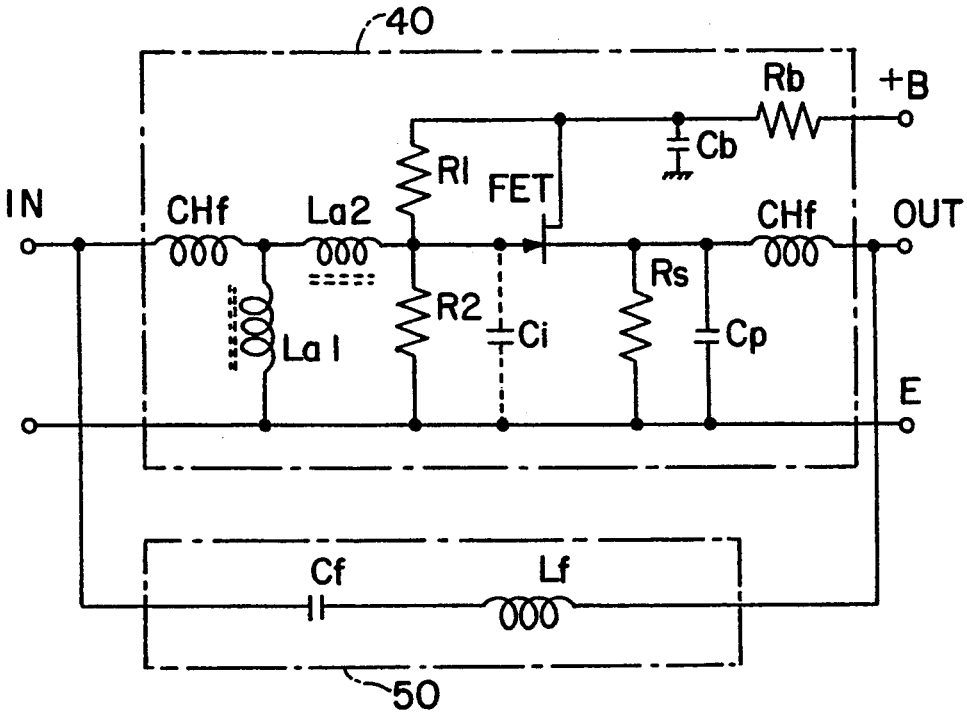
FIG. 5 is a circuit diagram of one example of the AM impedance conversion circuit used in the embodiment illustrated in FIG. 4.
Figure 6:
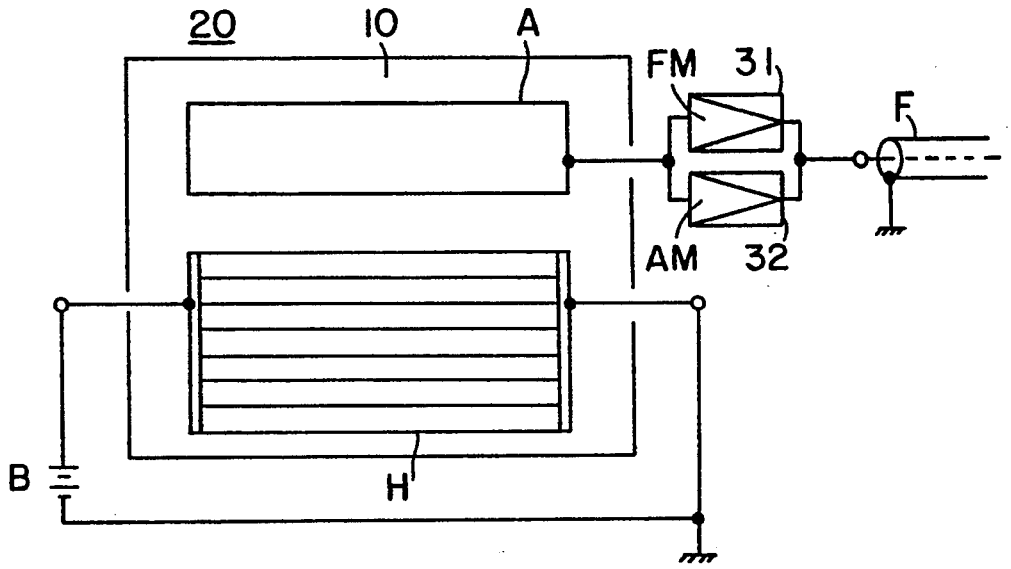
FIG. 6 PRIOR ART
FIG. 6 is an explanatory diagram of a conventional example.

In this embodiment, a compensating circuit, which consists of an AM impedance conversion circuit 40 and an FM matching-bypass circuit 50, is inserted between the feeder F and the output terminal of the wire W2. The AM impedance conversion circuit 40 converts high impedance which is for AM reception frequency into low impedance. An example of this AM impedance conversion circuit 40 is shown in FIG. 5.

Because of the AM impedance conversion circuit 40 thus installed, it is possible to greatly reduce the capacitance splitting loss in the feeder F compared to the embodiment shown in FIG. 1.

In the embodiment shown in FIG. 4, the wire W2, involving a resonance frequency adjusting capacitor Cf1 and a resonance frequency adjusting inductor Lfl, is resonant in the FM reception frequency band. However, either the resonance frequency adjusting capacitor Cf1 or the resonance frequency adjusting inductor Lf1 can be omitted. It is also possible to shape the wire W2 such that it can solely resonate in the FM reception frequency band. Furthermore, in the embodiment shown in FIG. 4, the heater wire H2, involving the resonance frequency adjusting capacitor Cf2, is resonant in the FM reception frequency band. It is, however, possible to use a resonance frequency adjusting inductor instead of the resonance frequency adjusting capacitor Cf2; and it is also possible to shape the heater wire H2 such that the heater wire H2 can solely resonate in the FM reception frequency band. Incidentally, both the resonance frequency adjusting capacitors and resonance frequency adjusting inductors can be utilized in order to achieve a resonance in the FM reception frequency band as in the case of the embodiment illustrated in FIG. 1.

Furthermore, it is also possible to use other type of conductors instead of wire W1. For example, transparent conductors obtained by forming silver, tin, etc., into a thin film with a thickness of a few microns can be used instead of the wire W1. In addition, though the above description is made about the reception of FM and AM frequency bands, the antenna of the present invention can be used for a first reception frequency which is not the FM reception frequency and for a second reception frequency which is not the AM reception frequency.

According to the present invention, the matching for the entire FM reception frequency can be accomplished by a simple structure. Also, since the heater wire is grounded in terms of high-frequency, it is possible to eliminate the noise from the power source, thus obtaining a good FM reception. As a result, the FM compensating amplifiers used in the conventional antennas are unnecessary, and the cost of the antenna can be low. Furthermore, a generation of noise and an occurrence of cross modulation, etc. are prevented.

What is claimed is:

1. A glass antenna for automobiles for receiving a first reception frequency band and a second reception frequency -band wherein said first reception frequency band is higher in frequency than said second reception frequency band, said antenna comprising:

a defogging heater wire which resonates in said first reception frequency band but not in said second reception frequency band, a terminal of said heater wire being grounded via a capacitor; and a conductor which is installed in said window glass and has an output terminal, said conductor being resonant in said first reception frequency band but not in said second reception frequency band, wherein said heater wire and conductor are installed in such a positional relationship that said heater wire and conductor are capacitively coupled together in said first reception frequency band so that said heater wire and conductor are respectively capable of reception in said first reception frequency band, and said heater wire and conductor are not capacitively coupled in said second reception frequency band so that reception of said second reception frequency band is accomplished only by said conductor, and wherein a resonance frequency adjusting inductor and a resonant frequency adjusting capacitor are coupled to said conductor for adjusting said conductor to resonate in said first reception frequency band.

2. A glass antenna for automobiles according to claim 1, wherein said resonance frequency adjusting inductor is connected to a feeder via a compensating circuit which comprises a matching circuit for said first reception frequency band and an active impedance converter which converts high antenna impedance for said second reception frequency band into a low impedance.

* * * * *